US006428209B1

(12) United States Patent
Janssen

(10) Patent No.: US 6,428,209 B1
(45) Date of Patent: Aug. 6, 2002

(54) SACK FROM A FLEXIBLE MATERIAL AND METHOD FOR ITS FORMATION

(75) Inventor: Paulus Johannes Maria Janssen, Heerlen (NL)

(73) Assignee: Frantschach Industrial Packaging Netherlands N.V., Maastricht (NL)

( * ) Notice: Subject to any disclaimer, the term of this patent is extended or adjusted under 35 U.S.C. 154(b) by 0 days.

(21) Appl. No.: 09/646,918

(22) PCT Filed: Apr. 9, 1999

(86) PCT No.: PCT/NL99/00213

§ 371 (c)(1),
(2), (4) Date: Oct. 13, 2000

(87) PCT Pub. No.: WO99/52784

PCT Pub. Date: Oct. 21, 1999

(30) Foreign Application Priority Data

Apr. 15, 1998 (NL) ..... 1008890

(51) Int. Cl.[7] ..... B65D 33/16
(52) U.S. Cl. ..... 383/93; 383/107; 383/113
(58) Field of Search ..... 383/107, 113, 383/42, 93

(56) References Cited

U.S. PATENT DOCUMENTS 684,181 A * 10/1901 Briery ..... 383/107
1,107,347 A * 8/1914 Powers ..... 383/107 X
1,341,834 A * 6/1920 Nelson et al. ..... 383/107 X
2,723,936 A * 11/1955 Ryan ..... 383/107 X
2,982,659 A * 5/1961 Mote ..... 383/107 X
3,653,913 A * 4/1972 Rambold ..... 383/107 X
5,322,700 A * 6/1994 Drake et al. ..... 383/107 X
5,616,434 A * 4/1997 Redden et al. ..... 429/136
5,863,431 A * 1/1999 Salzburg ..... 210/474
6,119,853 A * 9/2000 Garrill et al. ..... 383/113 X

FOREIGN PATENT DOCUMENTS

WO WO 97/172267 * 5/1997 ..... 206/440

* cited by examiner

*Primary Examiner*—Jes F. Pascua
(74) *Attorney, Agent, or Firm*—William C. Long

(57) ABSTRACT

The invention relates to a sack from a flexible material, such as paper and/or plastic material, which sack is provided with a longitudinal closing seam and/or a transverse closing seam, which connects to each other layers of material that lie on each other. According to the invention the closing seam is formed by attaching to each other the layers of material that lie on each other by plastic deformation of a part of said layers, without adding an adhesive such as glue and without adding heating energy. The invention also relates to a method for forming such a sack.

3 Claims, 2 Drawing Sheets

SACK FROM A FLEXIBLE MATERIAL AND METHOD FOR ITS FORMATION

Figure 1A:
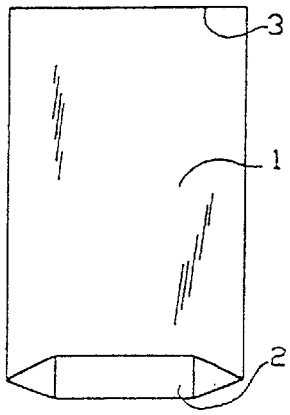

The invention relates to a sack from a flexible material, such as paper and/or plastic material, which sack is provided with a longitudinal closing seam and/or a transverse closing seam, which connects to each other layers of material that lie on each other. The invention also relates to a method for forming such a sack.

Such sacks are generally known. An example is a sack from a plastic material in the shape of a part of a plastic tube, of which first the transverse seam at one end is formed by sealing, and after filling the sack the transverse seam near the other end is formed by sealing in order to close the sack. The closing off can also take place by gluing or sewing, but this is less common. Another example is a paper sack, of which the longitudinal seam and the bottom are usually closed off by gluing. After filling the paper sack the open upper side is usually sewn closed or closed by gluing. When the product packed in the sack may not leak into the surroundings, such as a crop protection agent, or when the product has to be protected from for instance moist, the paper sack is provided with a plastic inner sack. Its closing off usually takes place by sealing.

A drawback of closing off a plastic sack with the help of sealing is that heat has to be supplied, as a result of which the product may be affected. Moreover some products and product surroundings may not be exposed to heat, for instance because of danger of explosion. Another drawback is that the adjustment of the sealing temperature is difficult to measure and hard to control, as a result of which the sealing seam might not seal well. With paper sacks it is a drawback that the glue or hotmelt has to be supplied to the seams, which requires time to let the glue or hotmelt stick or to activate it. For making a sewing seam it is disadvantageous among other things that the sack has to be placed accurately in a certain position and the sack can be recycled less well.

It is an object of the invention to provide an improved sack from a flexible material. It is another object of the invention to provide a plastic sack to which no heat has to be supplied after filling. It is yet another object to provide a paper sack which can be recycled well. Yet another object is to provide a sack of which the seam is reliably closed off. Yet another object is to provide a sack of which the seam can relatively easily be made.

According to a first aspect of the invention at least one of these objects is achieved with a sack of the kind described in the preamble, in which the closing seam is formed by attaching to each other the layers of material that lie on each other by plastic deformation of a part of said layers, without adding an adhesive such as glue and without adding heating energy.

Surprisingly it appeared that such a seam obtained by plastic deformation offers a sufficiently strong attachment to resist the shearing forces on the longitudinal seam or the peeling forces on the transverse seam of for instance the filling opening. The attachment between the layers of material is obtained without it being necessary to supply heat to seal (with plastic) and without it being necessary to apply glue or hotmelt (with paper), and without it being necessary to make a sewing seam (both with paper and with plastic). As a result the product in the sack is not affected by the heat or the glue and a paper sack can be recycled well. Also sacks from other materials, such as paper lined with aluminium or plastic, can be made by plastic deformation of the seams.

It is noted that in the older not pre-published Dutch patent application 1004420 of applicant's a valve sack is described of which the filling opening is closed by mechanical deformation. On such an filling opening, however, hardly any forces which could open the filling opening are active. The mechanical deformation was meant to prevent the streaming out of the product in the sack, such as cement. Making a longitudinal or transverse seam in the sack by plastic deformation is not described in said document.

Preferably the plastic deformation extends band-shaped over the length of the closing seam. Such a band-shape is easy to make with the help of two rotatable wheels or two clamping jaws at the location of both sides of the seam to be formed.

Preferably the plastic deformation has been accomplished by corrugating the layers of material. By corrugation a strong plastic deformation is created, which can easily be made.

Preferably the plastic deformation has been accomplished by knurling the layers of material that lie on each other. When knurling (German: prägen) a relief is pressed into the material, as a result of which the layers of material that lie on each other undergo a strong plastic deformation and adhere to each other.

According to an advantageous embodiment the sack consists of one single layer of paper, the closing seam being formed by attaching to each other the layers of paper that lie on each other by plastic deformation at the location of the closing seam. The sack is then formed from one single strip of paper. If so desired all seams could be obtained by means of plastic deformation; in any case it is profitable to make the closing seam of the open upper side by plastic deformation. Possible residues of the product at the location of the closing seam are either pushed away or integrated into the deformed layers of paper.

According to another advantageous embodiment the sack comprises two or more layers of paper, all layers of paper being attached to each other by plastic deformation at the location of the closing seam. Because all layers of paper are attached to each other the sack obtains an extra strength. When using glue this is only possible by applying extra glue between the layers.

According to yet another advantageous embodiment the sack consists of an inner sack of plastic material and an outer sack of one or more layers of paper, the transverse closing seam being formed by attaching all layers to each other by plastic deformation. As a result of the plastic deformation both sides of the plastic inner sack adhere to each other as well as the paper layers to the plastic inner sack and, if more than one layer of paper is present, to each other.

According to yet another advantageous embodiment the sack consists of plastic material, the closing seam being formed by attaching the plastic walls to each other by plastic deformation at the location of the closing seam. As a result of plastic deformation both the plastic sides of the sack adhere to each other without sealing being necessary. The plastic deformation can be performed quickly and easily. No time is needed to heat up the plastic to the softening temperature.

The sack for instance is a hexagonal bottom sack, of which the open upper side is closed after filling by attaching to each other the walls of the upper side that lie on each other by plastic deformation. A standard hexagonal bottom sack too can therefore be provided with a closing seam to be obtained by plastic deformation.

Preferably the sack is meant for accommodating approximately 1 kg or more of a product, and more preferably 2.5 kg or more.

According to another aspect the invention relates to a method for forming, filling and closing a sack from flexible material such as paper and/or plastic material, a tubular material being taken as starting point, which can be formed from a flat strip by making a longitudinal seam, after which a part of the tube is provided with a bottom sealing to form an open sack, and in which the sack after filling is provided with a top sealing. According to the invention the longitudinal seam and/or the bottom sealing and/or the top sealing is obtained by attaching to each other the layers of material that lie there on each other by plastic deformation, without an adhesive such as glue being added and without heating energy being supplied. With this method a sack with the above-mentioned advantages is obtained with the known forming, filling and closing technique, the longitudinal seam and/or sealing(s) being made by plastic deformation.

According to an advantageous method a part of the sack with top and/or bottom sealing which is formed by attaching the layers of material to each other by plastic deformation, is folded down and attached to the remaining part of the sack. In this way the sealing obtained by plastic deformation is less loaded during transport and the further processing of the sack.

The invention will be elucidated on the basis of some exemplary embodiments, referring to the drawing.

Figure 1B:
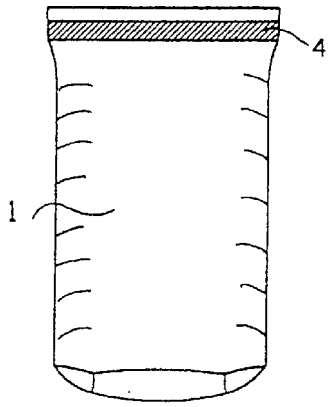
Figure 1C:
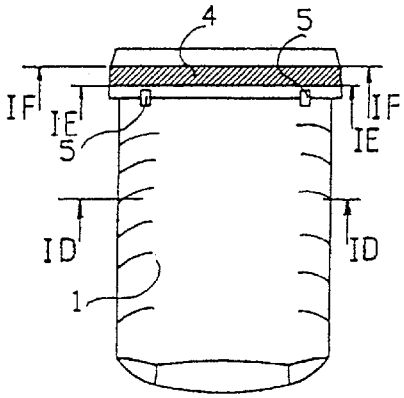

The FIGS. 1*a*, 1*b* and 1*c* schematically show the various stages in filling a hexagonal bottom sack.

Figure 1D:
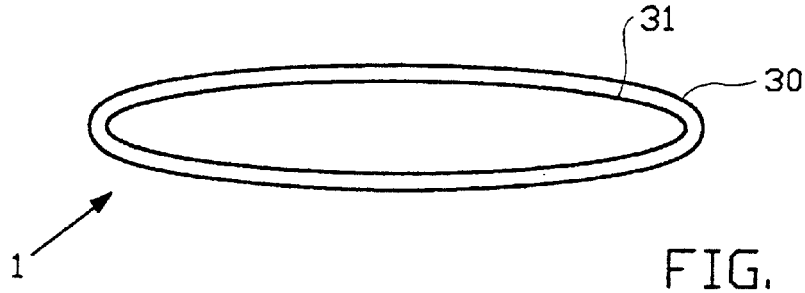
Figure 1E:
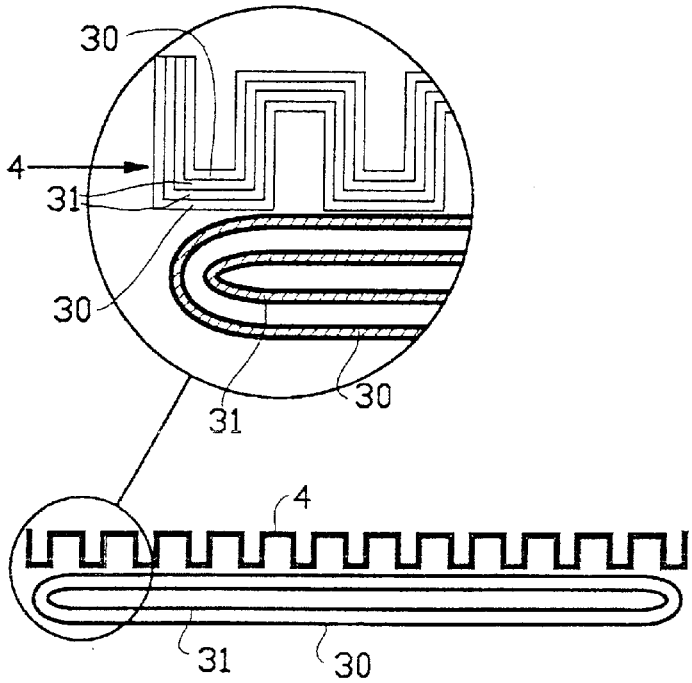
Figure 1F:
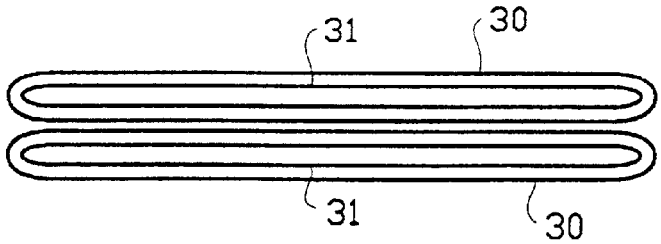

The FIGS. 1D, 1E and 1F show, respectivily, cross sections 1D, 1E and 1F through FIG. 1C.

Figure 2A:
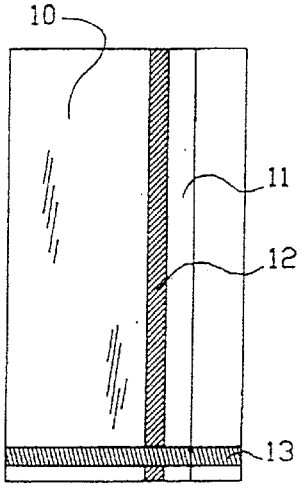
Figure 2B:
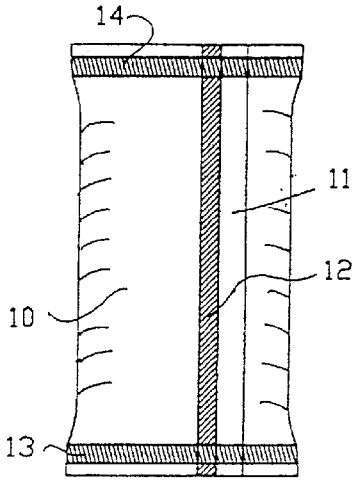
Figure 2C:
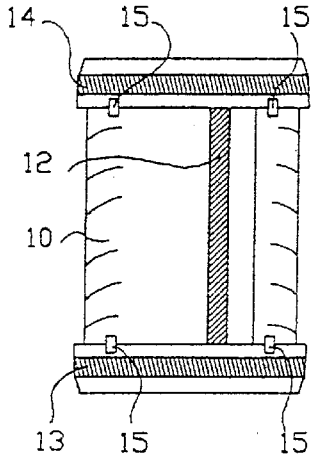

The FIGS. 2*a*, 2*b* and 2*c* schematically show the various stages in filling a paper sack.

Figure 3A:
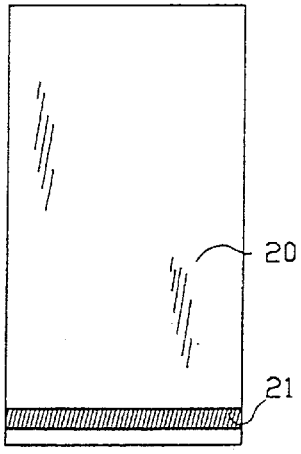
Figure 3B:
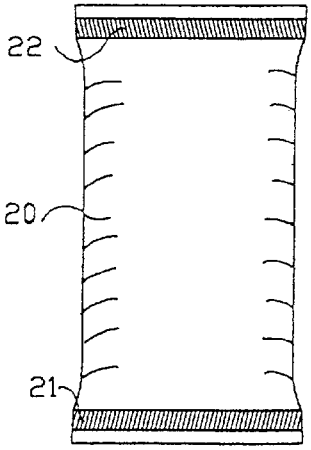
Figure 3C:
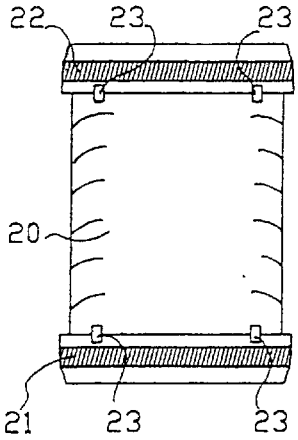

The FIGS. 3*a*, 3*b* and 3*c* schematically show the various stages in filling a plastic sack.

FIG. 1*a* very schematically shows a usual hexagonal bottom sack 1 with a hexagonal bottom 2 and an open upper side 3 in the situation in which the hexagonal bottom sack 1 is folded flat and not filled.

FIG. 1*b* shows the hexagonal bottom sack 1 according to FIG. 1*a* after it has been filled through the open upper side. Both sides of the open upper side are subsequently pressed onto each other, after which a band-shaped strip 4 over the full width of the upper side is attached to each other by plastic deformation. In the exemplary embodiment shown the band 4 is corrugated by knurling. Because of the plastic deformation of the sides of the hexagonal bottom sack 1 that lie on each other, both sides are attached to each other, because in plastic deformation both sides are also pressed firmly onto each other by the device with which the plastic deformation is performed.

FIG. 1*c* shows, that the upper side of the hexagonal bottom sack 1, in which the band-shaped sealing 4 is situated, is folded down and with the help of two attachment strips 5 attached to the filled portion of the hexagonal bottom sack 1. The filled hexagonal bottom sack 1 can now for instance be lifted at its upper edge, without all force having to be led through the plastically deformed band 4. It should be considered that the material at the location of the band 4 is somewhat weakened by the plastic deformation. The attachment strips 5 consist of paper-like material which for instance can be attaching with the help of starch glues. With a paper hexagonal bottom sack the hexagonal bottom sack 1 with attachment strips 5 and all therefore can completely be recycled after emptying. Instead of the attachment strips 5 the folded down upper edge of the hexagonal bottom sack 1 can also be attached to the remaining filled portion of the hexagonal bottom sack 1 by means of for instance point gluing, a paper-like (hotmelt) glue being used.

Making the plastically deformed band 4 has the advantage that no glue or hotmelt has to be supplied in a sealing seam and that the sealing of the hexagonal bottom sack 1 can be performed quickly and relatively easily, the traces of the material with which the hexagonal bottom sack has been filled not impeding the closing off. These traces are namely either pushed away when forming the band 4, or integrated into the plastic deformation.

Forming the plastically deformed band 4 can be performed with the help of various devices. A possibility is to make the band 4 in a hexagonal bottom sack 1 in one go with the help of two clamping jaws. Another possibility is to make the band 4 with the help of two wheels provided with corrugations, the wheels being moved from the one side edge of the hexagonal bottom sack to the other side edge and rotatingly forming the band.

Instead of a band-shaped plastic deformation 4 it is of course also possible to choose for another form of sealing, such as a zig-zag-shaped band, provided that it will close off the opening entirely.

The hexagonal bottom sack may consist of one layer of paper, but it is also possible that the hexagonal bottom sack 1 consists of two or more layers of paper. The plastic deformation of the band 4 then has the advantage that all layers are attached to each other at that location, as a result of which a strong hexagonal bottom sack is created.

In the hexagonal bottom sack 1 a plastic inner sack 3 may also be arranged, which plastic inner sack will adhere to itself by the plastic deformation of the band 4 and close off the hexagonal bottom sack, and which plastic inner sack will also adhere to the paper outer sack as a result of the plastic deformation.

FIG. 1D shows cross-section 1D of FIG. 1C, clearly showing an inner sack 31 and an outer sack 30.

FIG. 1E shows cross-section 1E of FIG. 1C, showing the plastic deformation band 4, inner sack 31 and outer sack 30. The enlarged view shows that the plastic deformation band 4 consistes of oposite layers which are directly on top of one another.

FIG. 1F whos cross-section 1F of FIG. 1C, again showing the inner sack 31 and outer sack 30.

FIG. 2*a* shows a paper sack which is formed from one broad strip of paper, of which the side edges are folded over each other and form an overlapping portion 11. In the overlapping portion 11 a longitudinal seam 12 is made, which in the exemplary embodiment is obtained by plastic deformation of the layers of paper that lie on each other. The lower side of the paper sack 10 is closed off by making a transverse sealing 13, which is also obtained by plastic deformation. Instead of a strip of paper a strip of plastic material could also be used.

FIG. 2*b* shows the sack 10 after it has been filled, and after the upper side which is open during filling has been closed off by making a plastically deformed transverse seam 14 there as well.

FIG. 2*c* shows that both ends of the sack 10 have been folded down and are attached to the filled portion of the sack 10 with attachment strips 15. Here as well the attachment strips 15 can be replaced for instance by hotmelt. The arrangement of the plastic deformation can be performed in a likewise manner as with the hexagonal bottom sack 1, in which it is noted that the longitudinal seam 12 is usually formed in a continuous process with the formation of a long paper tube, as a result of which the plastically deformed longitudinal seam 12 can be made most easily with wheels provided with corrugations.

FIG. 3*a* shows a plastic sack 20 which is formed of a continuous tube without longitudinal seam. One end of the sack 20 is provided with a transverse sealing 21, which could be made by plastic deformation. Instead of plastic deformation said sealing 21 could also be made by sealing. The other end of the sack 20 is open.

FIG. 3*b* shows the sack 20 after it has been filled through the open end, after which the open end is closed off by plastically deforming a transverse seam 22. By the plastic deformation of a transverse seam 22 no heat has to be supplied to the sack after the sack 20 has been filled. This is advantageous when the sack for instance contains foodstuffs. The absence of heat is also required, when the sack for instance contains combustible products.

FIG. 3*c* shows the sack 20 of which the ends are folded down and adhered with attachment strips 23, in analogy to the manner with paper sack 10.

In some cases the plastic sack 20 can be accommodated in the paper sack 10. The forming of the sack then takes place as described with reference to the FIGS. 2*a*, 2*b* and 2*c*.

It will be clear that the forming of longitudinal seams and transverse seams in order to close off sacks by means of plastic deformation can also be used with other sacks than the ones that are described above, such as sacks with a side fold.

All the sacks described above can be manufactured in the usual manner, in which only the forming of a seam is performed in a plastically deforming manner.

The sacks can be used for accommodating a weight of approximately 1 kg or more and in particular for accommodating a weight of approximately 2.5 kg or more of a product. Usual sacks are meant for accommodating a weight of for instance 5, 10, 20, 25 or 50 kg of a product. Other filling weights are possible as well.

What is claimed is:

1. A sack of a flexible material comprising two or more layers of paper, said sack having at least one closing seam conecting layers of paper that lile on one another, wherein the closing seam is obtained by placing opposite layers of paper directly on top on one another and attaching said opposite layers to one another by plastic deformation only at the location of the closing seam.

2. A sack of a flexible material, said sack comprising an inner sack of plastic material and an outer sack of one or more layers of paper, the sack having at least one transverse closing seam connecting layers of said flexible material that lie on one another, the transverse closing seam being formed by attaching all layers to each other by plastic deformation only.

3. The sack according to claim 1 or 2 characterized in that the sack is a hexagonal bottom sack, of which the open upper side is closed after filling by attaching to each other the walls of the upper side that lie on each other by plastic deformation only.

* * * * *